United States Patent [19]

Weimer et al.

[11] 3,950,861

[45] Apr. 20, 1976

[54] ROTARY DRYER FOR STRINGY MATERIAL

[75] Inventors: Ervin C. Weimer; Stuart M. Porter; Clark G. Hayes, all of Denver, Colo.

[73] Assignee: Stearns-Roger Corporation, Denver, Colo.

[22] Filed: Nov. 29, 1974

[21] Appl. No.: 528,336

[52] U.S. Cl. ..... 34/130; 34/135; 259/3; 259/151; 432/118

[51] Int. Cl.[2] ..... F26B 11/04

[58] Field of Search ..... 259/3, 151, 175, 81; 34/130–139; 432/118

[56] References Cited

UNITED STATES PATENTS

| | | | |
|---|---|---|---|
| 1,332,137 | 2/1920 | Newhouse | 34/137 |
| 1,883,722 | 10/1932 | Greisen | 34/134 |
| 2,246,252 | 6/1941 | Hummel | 34/109 |
| 2,578,166 | 12/1951 | Bill | 259/3 |
| 2,810,968 | 10/1957 | Pitt | 34/109 |
| 3,245,154 | 4/1966 | Bojner et al. | 34/109 |
| 3,258,253 | 6/1966 | Brown, Jr. | 259/175 |
| 3,829,066 | 8/1974 | Phillips | 259/3 |

*Primary Examiner*—Carroll B. Dority, Jr.
*Assistant Examiner*—Larry I. Schwartz
*Attorney, Agent, or Firm*—Sheridan, Ross & Fields

[57] ABSTRACT

There is provided a rotary dryer having an elongated rotatable tubular shell, the shell being axially subdivided into zones including a feed zone, a material distribution zone and at least one drying zone. In the drying zone there is provided a plurality of radially inwardly extending flight support members, the leading edges of which face the inlet end of the shell and extend inwardly and rearwardly from the inner surface of the shell toward the central axis thereof whereby hang up of fibrous material on the leading edges thereof is minimized. A plurality of longitudinally extending flights is secured to each of the support members.

6 Claims, 5 Drawing Figures

ROTARY DRYER FOR STRINGY MATERIAL

BACKGROUND OF THE INVENTION AND PRIOR ART

The present invention relates to a particular flight design and arrangement which has been found best suited to overcome a problem of hang up of stringy, elongate or fibrous materials, e.g. municipal waste, rubber tubing, rope, plastic, vegetable material, etc. within a rotary dryer. Hang up of such materials upon the edges of flights not only leads to non-uniformity of the product, but in some cases, stringy portions of a charge composition may be held up long enough and at a temperature high enough to ignite the material or cause it to char within the dryer. Moreover, the collection of stringy particulate material on the flights gradually causes a build up and eventual blocking of the apparatus. These problems are greatly alleviated in the structures embodying the present invention.

For the most part, rotary dryers in the past have consisted of a cylindrical shell having a plurality of similarly geometrically configured flights disposed at uniform circumferential intervals about the inner periphery of the shell. The dryer is mounted on suitable rollers or trunnions for rotation, and frequently inclined slightly to the horizontal to urge the material downwardly by gravity from the feed end toward the discharge end as it is repeatedly lifted and cascaded from the flights to the bottom of the dryer or an adjacent flight. For simple dehumidifying, for example, the drying of agricultural products, hot air may be used as a medium for abstracting moisture from the particulate material. The drying gases may be propelled in a direction counter to the flow of the material being dried, or in parallel, cocurrent relation to the material being dried.

Numerous modifications to this basic design of a rotary dryer have been proposed in the past including various inserts through the central portion of the dryer shell. These have taken various forms including stationary members as well as rotary members. A typical example of the latter is shown in U.S. Pat. No. 3,798,789 to Thompson. An annular type dryer of the vacuum type is shown in U.S. Pat. No. 2,837,831. A device which has compound flighting and an inner member is shown in U.S. Pat. No. 1,641,108 to West. Still another device for filtering sand or fines is shown in U.S. Pat. No. 3,076,270 to Madsen. U.S. Pat. No. 3,813,794 to Jawor teaches a rotary dryer device for tobacco or like material including guides supported interiorly of the dryer for cascading the material according to a predetermined path. One type of dryer used for drying of beet pulp includes a rotary shell having peripheral flights mounted therein, and a core composed of a plurality of X-shaped members disposed therein providing a honeycomb effect, the X's being disposed to permit material to fall through from one of the honeycomb members to the next.

The present invention is distinguished from the foregoing prior art in that it provides a rotary-type dryer characterized by at least three distinct zones: a feeding zone including a plurality of peripherally disposed flights or blades following a helical pattern; a distributing zone including a plurality of radially inwardly projecting flights or blades of similar geometric configuration at uniform circumferential positions; and the third zone for drying which is characterized by a plurality of flight support members or blades radially inwardly projecting from and secured to the rotary shell and characterized in that the leading edges thereof facing upstream toward the material feed end slope inwardly and rearwardly. Each of the support members carries a plurality of generally longitudinally extending flight members extending from either side thereof. It has been found that this particular design minimizes the hang up of fibrous or stringy materials and the problems which are encountered in other rotary dryer structures are apparently substantially avoided.

BRIEF STATEMENT OF THE INVENTION

Briefly stated, therefore, the present invention is in a rotary dryer which comprises in combination an elongated generally horizontally disposed rotatable tubular shell, said shell being axially subdivided into zones including a feed zone with or without a material distribution zone, and at least one drying zone. A plurality of radially inwardly projecting flight support members or blades are secured to the shell at uniform circumferential intervals in the drying zone or zones: the leading edges of which face the material inlet end of the tube and extend inwardly and rearwardly from the inner surface of the shell toward the central axis thereof whereby hang up of fibrous material on the leading edges thereof is minimized. Each of the flight support members is provided with a plurality of longitudinally extending flights.

In a more specific embodiment of the present invention, the support members are of different lengths and at regular intervals around the periphery of the shell, there usually being support members of short radial length, intermediate radial length and long radial length. In no case does the radially inward extension of the support member equal the radius of the tube. Each of the supports carries a plurality of longitudinally extending flight members, and these may have a configured surface as hereinafter more particularly described. The flight members extend alternately and oppositely from each surface of the support member, and in order to prevent undue flexure of the support members particularly in large diamemter dryers, there are conveniently provided backing plates to provide rigidity for the support members.

BRIEF DESCRIPTION OF THE DRAWINGS

The present invention may be better understood by having reference to the annexed drawings wherein.

DETAILED DESCRIPTION OF THE DRAWINGS

Figure 1:
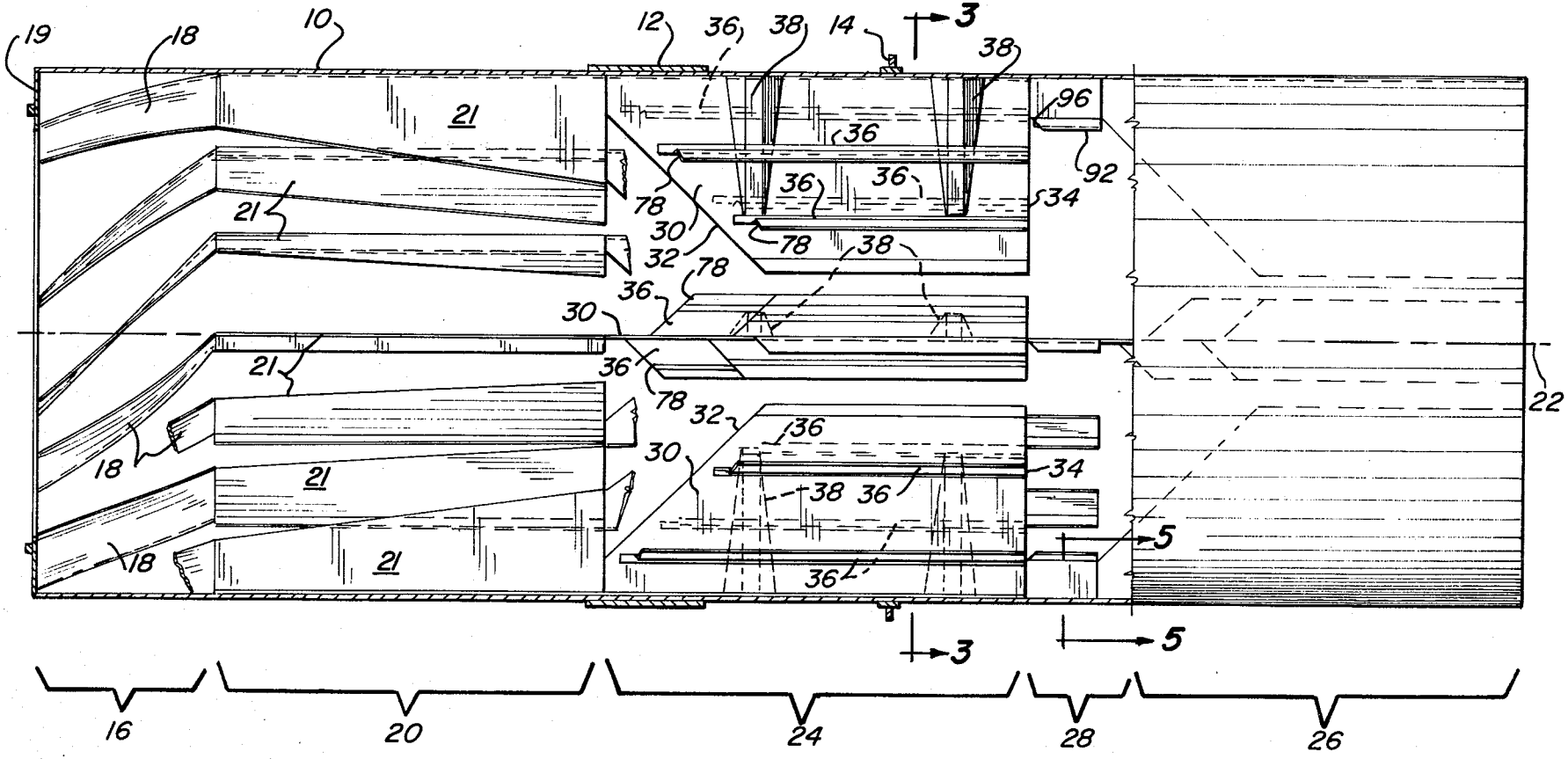
FIG. 1 is a longitudinal cross-sectional view of one embodiment of the present invention showing a feed zone, a distribution zone, and two drying zones (one in phantom) separated by an intermediate distribution zone.
Figure 2:
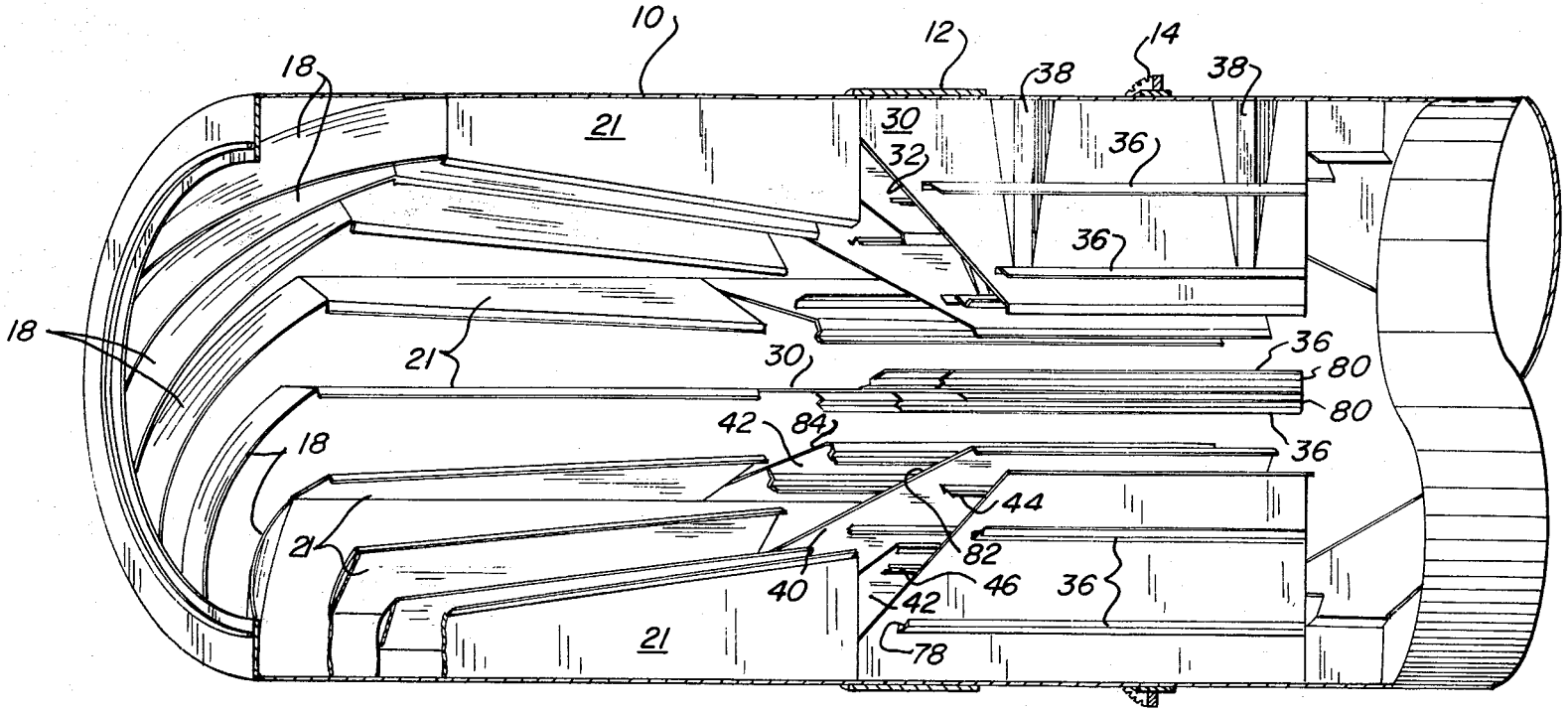
FIG. 2 is a partially cutaway perspective view of the embodiment shown in FIG. 1 showing in somewhat more detail the arrangement of the flights in the respective zones and their geometric configuration.

Referring now more particularly to FIGS. 1 and 2 of the drawings, there is here shown in longitudinal cross section, FIG. 2 being in cutaway perspective, an elongated tubular shell 10 conveniently fabricated of steel plate and welded construction. The shell 10 is desirably cylindrical in configuration and is provided with conventional trackway 12 encircling the shell and providing a runway for supporting rollers, and a circumferential drive ring 14 also of conventional structure and conveniently provided with gear teeth for meshing with a drive pinion not shown. The external structure of the rotary dryers of the present invention is largely conventional and may enbody a variety of configurations well known to those skilled in the art of manufacturing these devices.

The interior of the structure shown in FIGS. 1 and 2, and wherein the inventive features of the present invention reside, is divided as shown in FIG. 1 into a plurality of zones. The first zone indicated by the bracket identified with the number 16 is what shall for convenience herein be defined as a feeding zone. The feeding zone is provided with a plurality of circumferentially disposed inwardly projecting members or blades 18. These are conveniently sheet metal elements welded along one marginal edge to the interior surface of the shell 10. In a preferred embodiment of the invention, the blades 18 follow a helical path along the inner surface of the shell 10 from the charging end ring 19, and as the shell 10 rotates about its axis tends to guide the material introduced through suitable feeding means (such as a tube extending from a hopper, not shown) to an adjacent material distribution zone which for the purposes of this disclosure will be identified by the bracket numbered 20. This next zone includes flights or blades 21 extending generally parallel to the central axis identified by the numeral 22. The flights 21 are conveniently continuations of the blades 18. In the embodiment shown in FIGS. 1 and 2, these elements 21 preferably have a trapezoidal shape. The combination of this shape with the cascading action of the material as the drum 10 rotates effects a distribution of material for convenient entry into the actual drying zone. The elements 21 may have a rectangular shape, if desired. In some cases, the distribution zone 20 may be omitted, or it may be embodied in the feed zone 16, as for example by increasing the axial length of zone 16.

In the devices shown in FIGS. 1 and 2, there are two drying zones, the first being identified as 24, and the second being identified by the numeral 26. The zones 24 and 26 each contain material cascading apparatus of similar design and construction. Between the drying zones 24 and 26 there is desirably, although not essentially, provided a short intermediate zone identified by the number 28 which again is a material distribution zone preceding the drying zone 26. This intermediate zone also aids in servicing the interior of the drier during down time by providing access space for clearing the drying zones 24 and 26.

The right hand end of the tube as shown in FIG. 1 is the discharge end of the apparatus.

The drying zone 24, for example, is segmented into a plurality of pie-shaped zones by flight support members or blades such as the support member or blade 30 as shown in FIG. 1. The support members 30 are provided with a leading edge 32 which extends inwardly and rearwardly, in the case shown in FIG. 1 at an angle of 45°. The trailing edge 34 of the support members 30 is normal to the central axis 22. Support members 30 project radially inwardly from the shell 10 and are secured thereto by any suitable means such as welding. These support members carry a plurality of flights 36 extending alternately and oppositely from either side of the support member 30 and extending in a direction which is generally parallel to the central axis 22 of the drum 10. Because in some instances the radial inward length of the support members 30 is fairly large, a steel backing member or a plurality thereof, 38 may be provided, these being shaped as shown in FIG. 1 in dotted lines adjacent to central axis 22 to provide minimal resistance to the flow of particulate material and offer minimal opportunity for hang up of fibrous portions thereof. The plan profile of the braces 38 or backing members 38 is also shown in FIG. 1 both above and below the central axis 22, the depiction above being in solid lines, and that below being in dotted lines.

Figure 3:
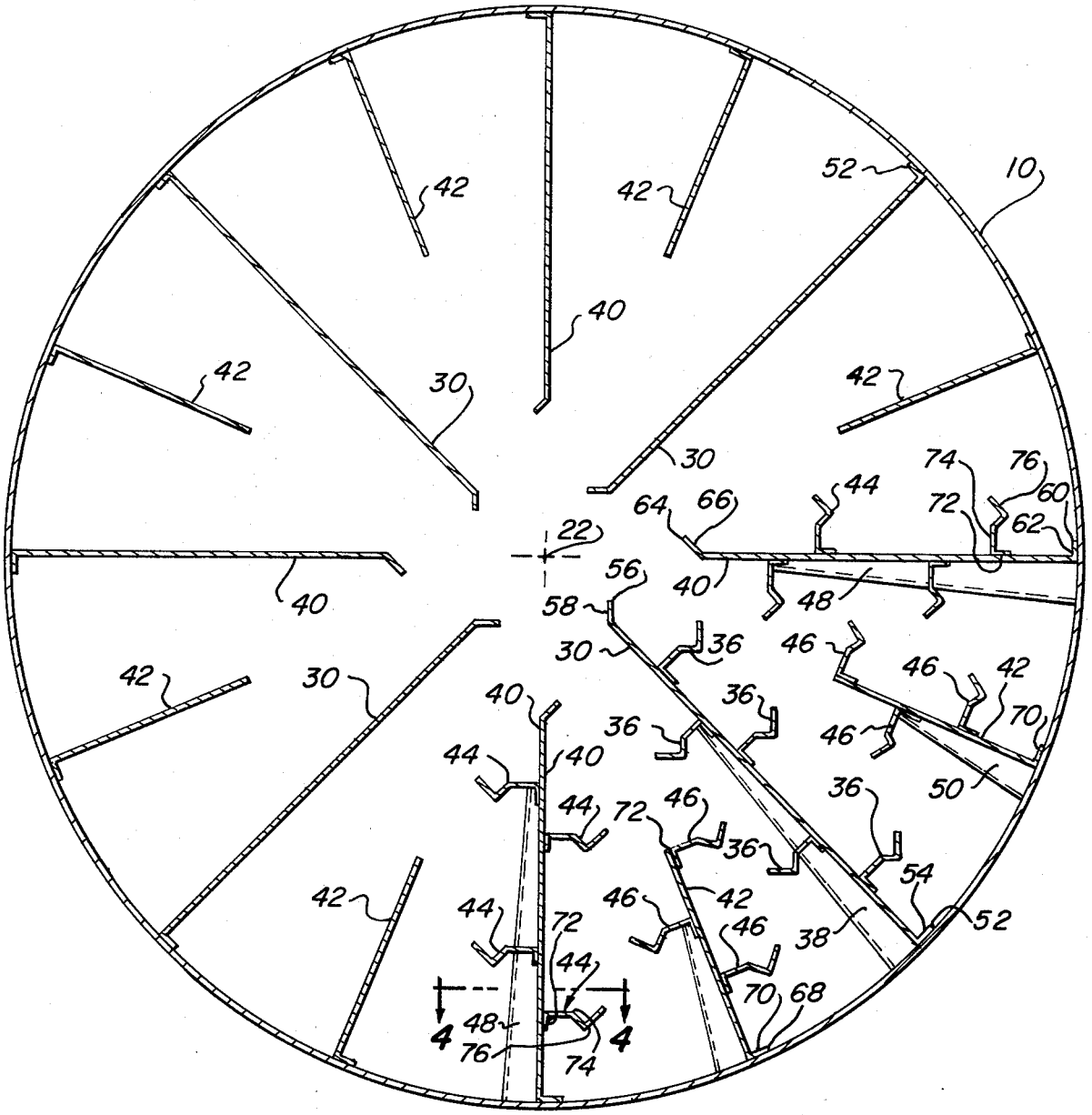
FIG. 3 is a fragmentary transverse cross-sectional view showing the support members and braces threfor together with an arrangement of laterally extending flights supported thereon. This view is taken in the plane indicated by the line 3—3 in FIG. 1.
Figure 4:
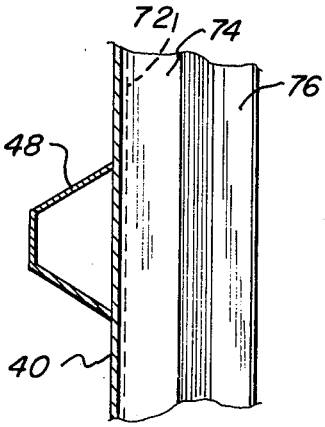
FIG. 4 is a fragmentary cross-sectional view of a support member and the reinforcing backing member associated therewith on an enlarged scale and as it appears in the plane indicated by the line 4—4 in FIG. 3.

As in seen in FIG. 2 and in better detail in FIG. 3, the flight support members discussed in connection with FIG. 1 are those identified by the numeral 30. As will be seen from FIG. 3, a preferred embodiment is provided not only with support members 30, but also support members 40 of intermediate length, and support members 42 of relatively short length. Thus, in the preferred embodiment illustrated in the drawings, there are provided four long support members 30, and these are disposed at 90° intervals, four intermediate support members 40 disposed also at 90° intervals but displaced 45° from the long support members 30, and eight short support members 42 disposed at 45° intervals and 22½° from each of a long support member 30 and an intermediate support member 40. As shown in FIG. 3, the long support members 30 are provided with flights 36 of which there are five in number, the flights 36 being disposed alternately and oppositely extending from the support member 30 and parallel to the central axis 22. In like manner, the intermediate support members are also provided with flights 44 alternately oppositely extending from the opposite surfaces of the support member 40, and being secured thereto by any convenient means such as welding. Each support member 40 of intermediate radial length is provided with four flights 44 which are parallel to the central axis 22. Also in like manner, the short support members 42 are provided with flights 46 which like the others are generally parallel to the central axis 22 of the drum 10. The long support members 30 were provided with braces or struts 38 to stiffen the support member 30 and prevent it from warping or buckling under the weight of material carried thereon. The intermediate length support members 40 are also provided with struts or braces 48 of similar design and construction to the braces 38. Also, the short support members 42 are provided with braces 50 of similar configuration to the braces 38 and 48. The flights 36, 44 and 46 are, as indicated, disposed generally parallel to the central axis 22 of the drum 10.

The support members 30, 40 and 42 are preferably of generally trapezoidal configuration. As best shown in FIG. 3, the longer of the two parallel sides 52 of the trapezoidally-shaped support member 30 is bent out of the plane of the support member to form a flange 54 adapted for welding to the internal surface of the drum 10 and along a geometrical element of the cylindrical shell 10. The shorter side 56 of the trapezoidally-shaped support member 30 is also bent out of the plane of the support member along a line parallel to the marginal edge thereof to form a lift 58. The lift 58 is formed at an angle of about 45° to the plane of the support member 30. In like manner, the intermediate support member 40 is also trapezoidally shaped, and the longer edge 60 is bent out of the plane to form a flange 62, and the shorter edge 64 is bent out of the plane to form a lift 66. The short support members 42 are also trapezoidally shaped, and the longer of the parallel edges 68 is bent out of the plane of the support member 42 to form a flange 70 for securement to the inner surface of the drum 10 as by welding. The shorter marginal edge 72 of the parallel edges is not bent to form a lift, and instead there is provided along the edge 72 a lift or flight 46 secured therealong as by welding. The bends are made along lines parallel to the marginal edges to form the welding flanges and lifts 58 and 66. Although for convenience in fabrication the leading edges of the support members 30, 40 and 42, are straight lines, they may as effectively be curved.

As is best seen in FIG. 3, the flights 36, 44 and 46 have a common cross section. Considering a flight 44 indicated by the arrow in FIG. 3, the flight includes a flange 72 adapted for securement to the support member 40 as by welding. The laterally extending portion 74 is provided with a gutter portion 76 along its distal edge which in the preferred embodiment is V-shaped. The flights 44, for example, need not be provided with a gutter portion 76, however the performance and capacity of the flights is increased thereby. As indicated, the flights 36, 44 and 46 desirably have the same general cross section. As is best shown in FIG. 1, the leading edges 78 of the flights 36 are raked rearwardly at an angle of 45° to the plane of the support members, e.g. support members 30. The trailing edges 80 of the flights 36 are square, i.e., 90° to the plane of the support members 30, for example. The support members 40 and 42 are also provided with inwardly and rearwardly extending leading edges 82 and 84, respectively, the rake angle in the embodiment shown being 45°. The flights 44 and 46 associated with the support members 40 and 42 are configured as are the flights 36 with respect to their leading and trailing edges, and with respect to their cross section. It will be noted that the flights 36, 44 and 46 are not of identical axial length. This length is determined, of course, by the radial location of the flight and the distance between the raked back leading edge and the trailing edge along the line of attachment to the support member. As best shown in FIG. 1, this length is conveniently slightly less than the aforesaid distance.

Figure 5:
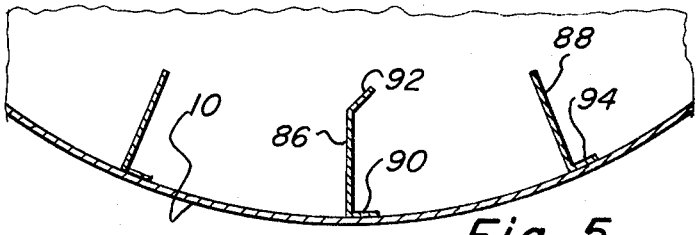
FIG. 5 is fragmentary cross-sectional veiw on an enlarged scale of an intermediate distribution zone as it appears in the plane indicated by the line 5—5 in FIG. 1.

After passing through the drying zone 24, material passing through the dryer may enter a material distribution zone 28 prior to entering a second drying zone 26. FIG. 5 is a fragmentary cross section on an enlarged scale of the distribution zone 28 showing flights 86, and baffles 88 in alternating relation. The flights 86 and the baffles 88 are in line with the support members 30, 40 and 42 at 22.5° intervals, the flights 86 being at 45° intervals, and the baffles 88 being disposed at 45° intervals also but 22.5° displaced from the flight members 86. The flight members 86 are generally radially inwardly directed plates having a flange 90 bent out of the plane of the flight 86 at an angle suitable for securement to the inner surface of the shell 10 as by welding, and a lift 92 along the distal marginal edge bent out of the plane of the flight 86 at an angle of about 45°.

The baffles 88 are of similar construction but omit the lip 92. Thus the baffle 88 is provided with a flange 94 adapted for securement to the inner surface of the drum 10 as by welding. As best shown in FIG. 1, where a lip 92 is provided, the leading edge 96 thereof is raked back at an angle of about 45° to the central axis 22 again for the purpose of minimizing hang up of fibrous or stringy particles and enabling succeeding material to wipe any stringy fragments which may become hung up on such leading edge 96 easily away therefrom. Both the flights 86 and the baffles 88 are of relative short radial extent, e.g. about 20 percent to 25 percent of the radius.

The succeeding drying zone 26 includes a duplicate of the packing found in the drying zone 24. As indicated above, there may be one, two or more such drying zones each provided with a preceding material distribution zone such as zone 28 or in the case of the forward drying zone 24, a distribution zone 20.

In the specific embodiment shown and for the purpose of illustrating general proportions, the shell 10 is approximately 10 feet 6 inches in diameter. The diameter of the inlet is approximately 8 feet 2 inches. The length of the feed zone 16 is approximately 3 feet 4 inches, the axial length of the distribution zone is approximately 7 feet 10 inches, the axial length of the initial drying zone 24 is 8 feet 6 inches, the axial length of the intermediate distribution zone is 1 foot 4 inches, and the final drying zone 26 has an axial length of 8 feet 6 inches. Exclusive of the lips 58 and 66, the radial inward projection of the long support members 30 is 4 feet 4 inches; the inward projection of the intermediate supports is 3 feet 8 inches and that of the lipless short support members is 2 feet 2 inches. The lifts, e.g. lifts 36, 44 and 46 are about 8 inches wide.

It has been found that with devices of the type above described in detail, heat transfer from the gaseous medium to the particulate medium is aided by the heat transfer due to conduction from the steel plate to the gas as well as from the gas to the product. This structure also minimizes bypassing of the gases which in some cases causes dehydration of the dried product at the discharge end of the drum and thus lowers smoke emission. For a given size of drum, the retention time is increased because of the relatively short fall and increased surface area permitting a higher gas velocity. The design includes lengthwise spacing of the sections of baffles or support members, e.g. support member 40 that enable access for installation and future maintenance. Thus, the section defining zones 26 and 28 may be removed from the forward section 24. Successive sections equivalent to the combination of sections 28 and 26 may be secured in tandem depending upon the material being dried.

What is claimed is:

1. A rotary dryer comprising the combination of:

an elongate generally horizontally disposed rotatable tubular shell divided into at least a forward zone and a rear zone;

a plurality of material handling blades located in the forward zone and secured to the inner wall of the shell in longitudinally extending peripherally spaced relation and extending inward toward the axis of the shell in radial planes containing the axis of the shell;

the trailing edges of the blades lying substantially in a common plane normal to the axis of the shell, and having a predetermined radial length;

and a plurality of flight support blades located in the rear zone and secured to the inner wall of the shell in longitudinally extending peripherally spaced relation and extending inward toward the axis of the shell in radial planes containing the axis of the shell, with the forward portion of each blade being in longitudinal alignment with the aft portion of a corresponding blade in the forward zone and coplanar therewith;

the forward end of each blade in the rear zone having a first leading edge portion extending inward from the shell wall substantially in a common plane normal to the axis of the shell immediately aft of the trailing edge of a corresponding blade in the forward zone, with a radial extent substantially less than that of the trailing edge of the forward blade, and having a second leading edge portion extending from the inner end of the first leading edge portion rearward and inward toward the axis of the shell into conjunction with the longitudinally extending inner marginal edge of the blade.

2. A dryer as claimed in claim 1; in which at least one half of the blades in the rear zone have longitudinally major portions whose radial extents are substantially greater than the radial extents of the corresponding blades in the forward zone.

3. A dryer as claimed in claim 1; in which the blades in the rear zone are provided with flights extending fore and aft with their forward ends located aft of the blade leading edges and raked at approximately the same angle as the leading edges.

4. A dryer as claimed in claim 3; in which there are a plurality of flights on each blade spaced successively radially inward;

and each successive inwardly spaced blade is shorter than the adjacent outwardly spaced blade.

5. A dryer as claimed in claim 1; in which the blades in the forward zone are trapezoidal in planform with their inner marginal edges extending rearward and inward toward the axis of the shell.

6. A dryer as claimed in claim 1; in which the forward zone is subdivided into a forward first zone section and an aft second zone section;

the material handling blades are located in the second zone section and a plurality of feeder blades are located in the first zone section;

the feeder blades are secured to the inner wall of the shell in peripherally spaced relation and extend radially inward toward the shell axis and longitudinally in helical patterns from the forward wall of the dryer to the forward ends of the material handling blades;

and the trailing edge of each feeder blade is juxtaposed in radial alignment with the leading edge of a corresponding material handling blade.

* * * * *